US006175346B1

(12) United States Patent
Chiu et al.

(10) Patent No.: US 6,175,346 B1
(45) Date of Patent: Jan. 16, 2001

(54) DISPLAY DRIVER AND METHOD THEREOF

(75) Inventors: Scott Chiu; Scott R. Novis, both of Tempe, AZ (US)

(73) Assignee: Motorola, Inc., Schaumburg, IL (US)

( * ) Notice: Under 35 U.S.C. 154(b), the term of this patent shall be extended for 0 days.

(21) Appl. No.: 08/740,052

(22) Filed: Oct. 24, 1996

(51) Int. Cl.[7] ..... G09G 3/32
(52) U.S. Cl. ..... 345/82; 345/100
(58) Field of Search ..... 345/115, 116, 345/147, 113, 132, 133, 141, 148, 150, 82, 61, 38, 98, 100; 327/94

(56) References Cited

U.S. PATENT DOCUMENTS 4,441,105 * 4/1984 Van Vliet et al. ..... 345/116
4,649,432 * 3/1987 Watanabe et al. ..... 345/148
5,111,194 * 5/1992 Oneda et al. ..... 345/147
5,473,341 * 12/1995 Tomiyasu ..... 345/116

* cited by examiner

*Primary Examiner*—Chanh Nguyen
(74) *Attorney, Agent, or Firm*—Lanny L. Parker

(57) ABSTRACT

A display driver circuit having graphics and bilevel modes drives a display (110). A column control circuit (112) includes a shift register (302) with display blanking and bi-directional shifting for scanning the display (110) in either direction for driving display (110) from either end. A dual mode row driver (502) provides graphics capability for displaying images and low power operation when displaying text. In graphics mode, a four-bit luminance word controls a row drive pulse to produce a representative pixel brightness in the display (110). In bilevel mode, the system clock ($V_{CLOCK}$) is reduced in frequency to conserve power while maintaining data transfer and refresh rates.

5 Claims, 3 Drawing Sheets

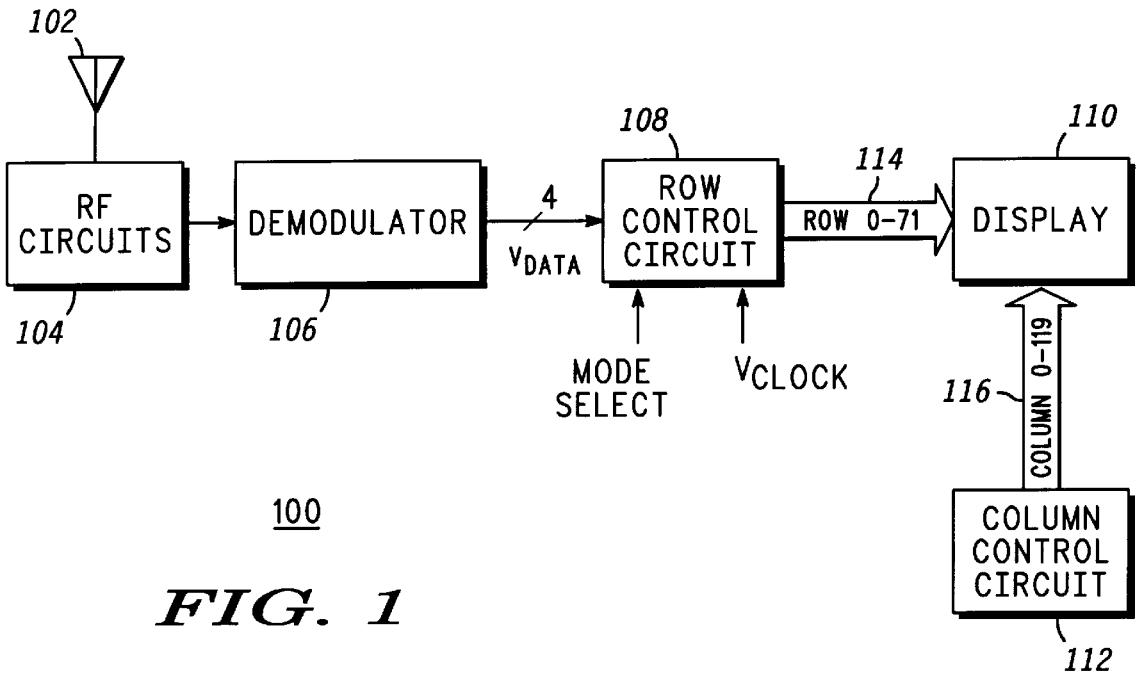
FIG. 1
FIG. 2
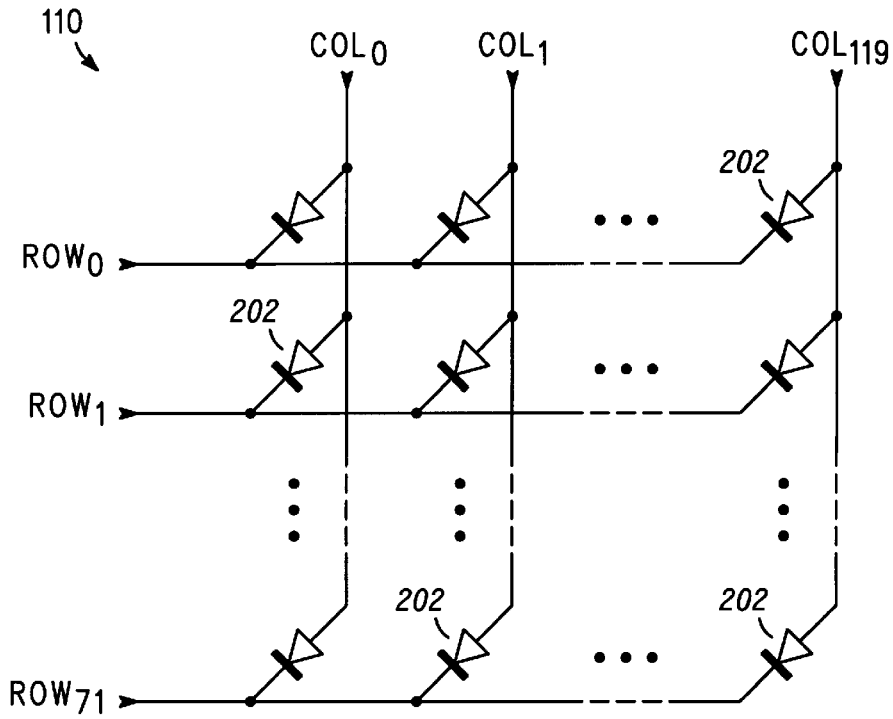

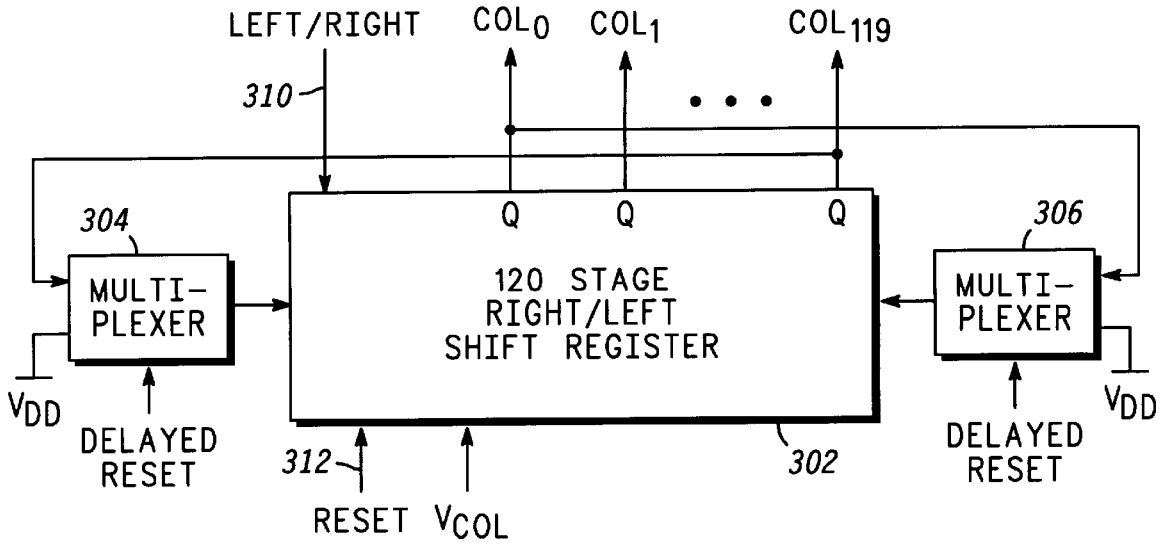
112
FIG. 3
FIG. 4
302
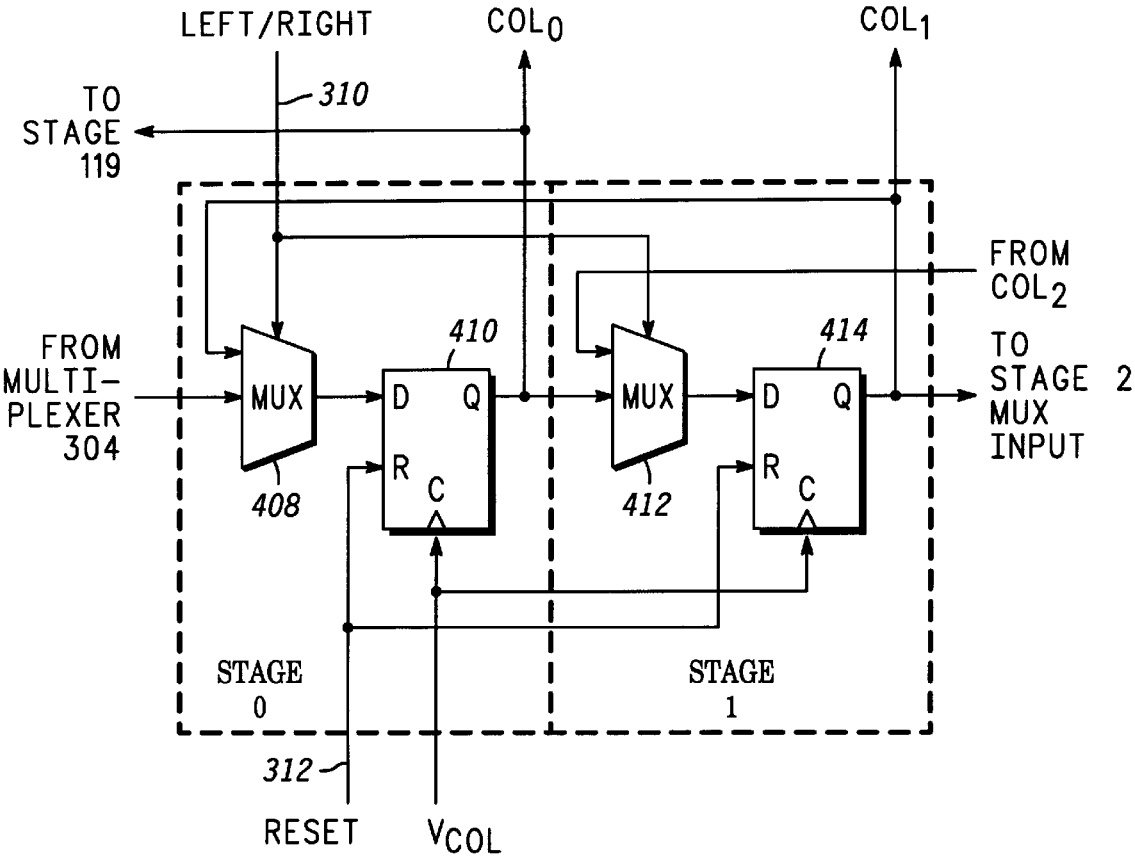

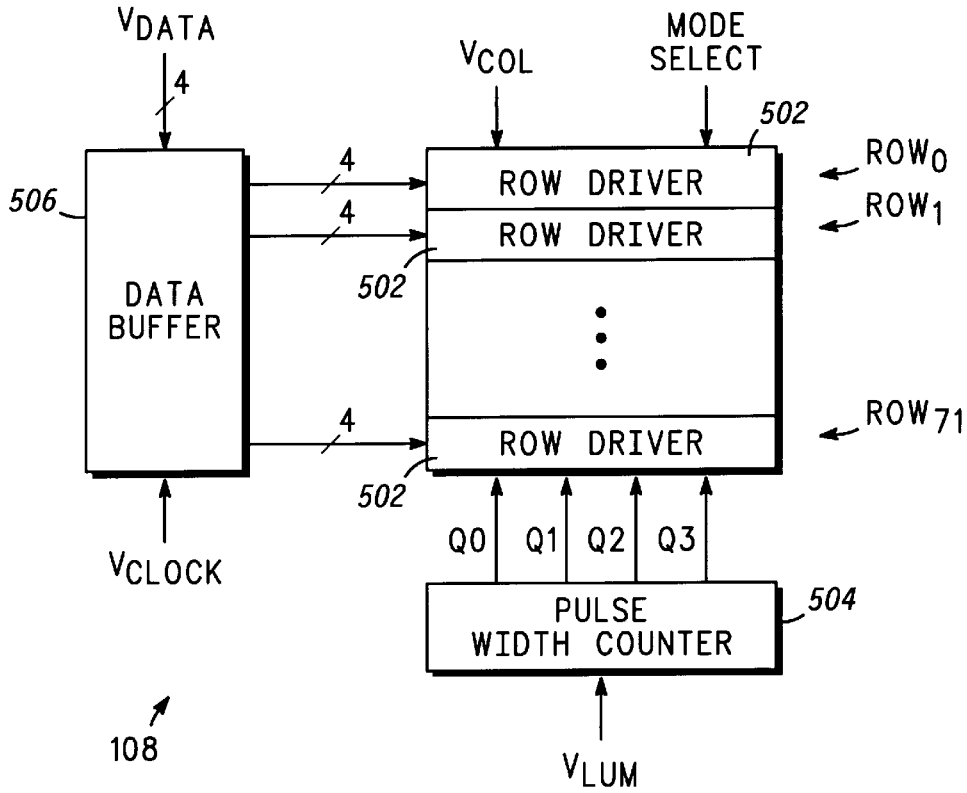
FIG. 5
FIG. 6
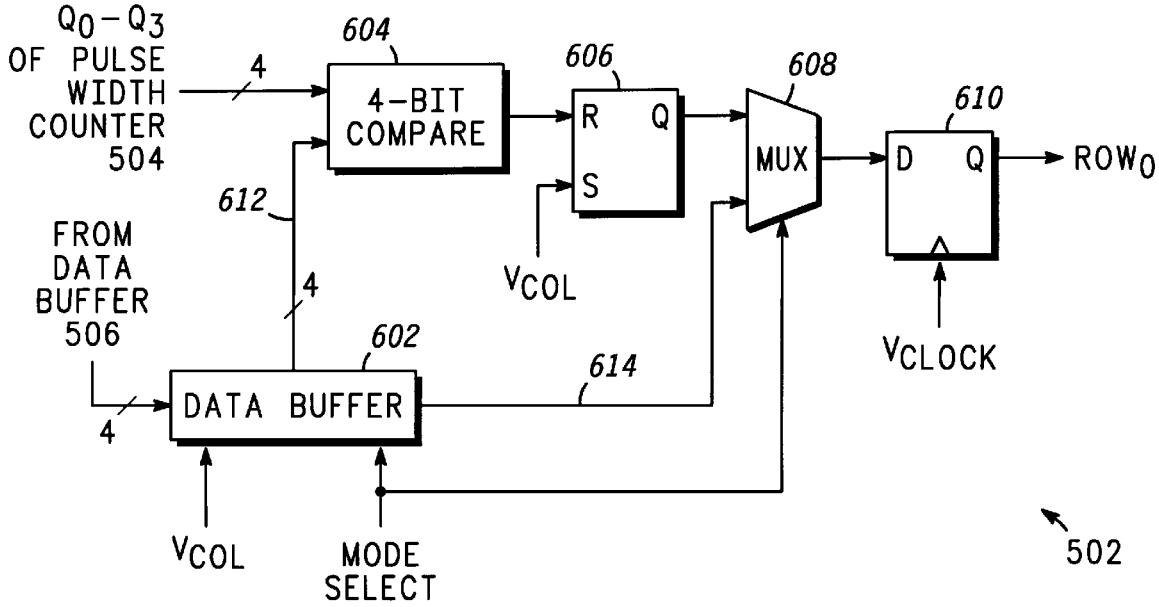

DISPLAY DRIVER AND METHOD THEREOF

CROSS REFERENCE TO RELATED PATENT APPLICATIONS

The present application is related to copending U.S. Patent Applications, entitled "SCALEABLE REFRESH DISPLAY CONTROLLER," filed Oct. 24, 1996, by Inventors Scott Chiu and Scott Novis; entitled "NONLINEAR GRAY SCALE METHOD AND APPARATUS," filed Oct. 24, 1996, by Inventors Scott Chiu, Karen Jachimowicz and George Kelly; and assigned to the same assignee, Motorola Inc.

BACKGROUND OF THE INVENTION

This invention relates in general to display drivers and, more particularly, to integrated circuits for driving light-emitting device displays.

Wireless communications devices typically include displays for conveying status and other information to a user of the wireless communications device. For example, a pager display can indicate that a page has been received or can display the phone number of the person paging. Most displays currently used in pagers are limited to displaying alphanumeric text because the display drivers only operate in a bilevel mode where pixels are either turned off or turned on to a fixed brightness level. Such display drivers cannot provide a variable pixel brightness needed for viewing images. Bilevel mode displays are adequate where the overall complexity of the pager is low, but with increasing functionality comes a need for a graphics user interface (GUI) to facilitate controlling the operation of the pagers. A high resolution, emissive display such as a light-emitting device such as a light-emitting diode (LED) display provides a GUI for viewing images, such as facsimile messages or images downloaded from the Internet, as well as alphanumeric characters. A typical LED display is organized into a plurality of rows and columns, and the display is operated by scanning, e.g., columns and activating rows to illuminate the pixels in the column.

A prior art display driver uses a binary counter combined with a decoder to select columns. The binary counter counts through the columns and the decoder selects a column based on the binary count. However, each column driver needs an extra latch at the outputs of the decoder to prevent the display from displaying random patterns during power up or system reset. The extra latch increases the cost and complexity of the display driver. The large number of pins needed for driving columns on larger displays further increases the cost. A less costly approach would be to use two smaller display drivers, one driving even columns from one end and another driving odd columns from the other end of the display. However, prior art display drivers only scan columns in one direction, say from left to right, so they can only drive the display from one specific end. If they are connected to the opposite end, the columns will be scanned backwards. As a result, cost is increased because either a complex interconnect scheme or different versions of the display driver are needed for driving the display from both ends.

For activating pixels, row drivers provide gray scale shading when displaying graphics images and pixel on/off control when displaying text. Gray scale shading requires more data transfers and more complex circuits because more data bits are needed for graphics than for text. Displaying graphics therefore requires higher frequency data transfers to accommodate the increased data flow, which increases power consumption and reduces the time between battery recharges.

Hence there is a need for a graphics mode display driver which can drive either end of a display while reducing power consumption in applications such as portable wireless communications devices.

BRIEF DESCRIPTION OF THE DRAWINGS

FIG. 1 shows a communication device;

FIG. 2 shows a schematic diagram of a display;

FIG. 3 is a block diagram of a column control circuit;

FIG. 4 is a schematic diagram of two stages of a column control circuit;

FIG. 5 is a block diagram of a row control circuit; and

FIG. 6 is a schematic diagram of a row driver.

DETAILED DESCRIPTION OF THE DRAWINGS

FIG. 1 shows a block diagram of a wireless communications device 100, such as a pager or cellular telephone. Antenna 102, radio frequency (RF) circuit 104 and demodulator 106 comprise a receiver circuit portion of wireless communication device 100. Antenna 102 receives a transmitted RF carrier signal modulated with digital data including control data for operating communications device 100 and video data for displaying either text or graphics images. The RF carrier signal is coupled to RF circuit 104 for tuning and amplification. The amplified RF carrier signal is received by demodulator 106 to recover a baseband multi-bit video data stream $V_{DATA}$, which is clocked into row control circuit 108 by a system clock $V_{CLOCK}$ operating at a frequency of 1.25 megahertz in graphics mode. System clock $V_{CLOCK}$ is typically the highest frequency clock in communications device 100. Video data stream $V_{DATA}$ is shown having four bits carried on a four-bit bus, but the width can be varied as appropriate for implementing communications device 100. Video data stream $V_{DATA}$ includes digital control information and a series of four-bit luminance words for activating pixels in display 110.

Display 110 includes an array of LED devices organized into 72 rows and 120 columns. Alternatively, display 110 can be configured to support higher resolutions by sequential addition of rows and columns or by interdigitating signals along both axes to create a larger display area, for example, 144 rows by 240 columns. The 72 rows are coupled to display inputs at conductors $ROW_0$through $ROW_{71}$ and to corresponding outputs of row control circuit 108. The 120 columns are coupled to display inputs at conductors $COL_0$ through $COL_{119}$ and to corresponding outputs of column control circuit 112. A LED pixel is illuminated when a column is selected and a row is activated.

Column control circuit 112 operates in a column scan mode to select one column at a time by providing a column drive signal on one of the conductors $COL_0$ through $COL_{119}$. Column control circuit 112 scans either from left to right or from right to left, i.e., from $COL_0$ to $COL_{119}$ or from $COL_{119}$ to $COL_0$. The outputs of column control circuit 112 are laid out in sequence to facilitate connecting to display 110. As a feature of the present invention, two column control circuits 112 can drive larger displays from both ends. For example, a 240 column display can have a column control circuit 112 connected to one end of display 110 for scanning even columns from left to right and another column control circuit 112 connected to the other end of display 110 for scanning odd columns from right to left. Such a configuration provides direct column connection to minimize interconnect complexity and cost.

Row control circuit 108 activates the LED pixels in a selected column in parallel in either graphics or bilevel mode. Luminance words of video data stream $V_{DATA}$ are loaded into individual driver cells of row control circuit 108 by system clock $V_{CLOCK}$. In graphics mode, row control circuit 108 modulates an activating pulse to a width determined by the value of the luminance word in order to provide gray scale shading for displaying graphics images on display 110. In bilevel mode, row control circuit 108 produces a fixed-width pulse based on the value of a luminance bit in the luminance word for displaying alphanumeric characters. Row control circuit 108 further includes an input for receiving a MODE SELECT control signal for switching between bilevel and graphics modes.

Referring to FIG. 2, a schematic diagram of display 110 is shown including an array of LED devices 202 organized into 72 rows and 120 columns. Each LED 202 operates as a display pixel of display 110. Rows are coupled to conductors $ROW_0$ through $ROW_{71}$ and to respective outputs of row control circuit 108. Columns are coupled to conductors $COL_0$ through $COL_{119}$ and respective outputs of column control circuit 112. The anode and cathode of each LED 202 is uniquely connected to a column conductor and row conductor, respectively, of display 110. LED 202 is illuminated by selecting a column and activating a row. In a graphics mode, the brightness of LED 202 is determined by the value of a four-bit luminance word in video data stream $V_{DATA}$. In a bilevel mode, each luminance word provides on/off information for four LEDs 202. Thus, four times as much data is processed by row control circuit 108 in graphics mode than in bilevel mode.

Further detail of column control circuit 112 is shown in FIG. 3, including a 120 stage shift register 302, a multiplexer 304 and a multiplexer 306. Column control circuit 112 operates as a bi-directional ring counter whose direction is controlled by direction signal LEFT/RIGHT applied at input 310. Column clock VCOL shifts a column drive signal through shift register 302 either from $COL_0$ through $COL_{119}$ or from $COL_{119}$ through $COL_0$.

Multiplexer 304 couples either a signal at $COL_{119}$ or a fixed voltage representing a logic 1 state, such as a power supply voltage $V_{DD}$=3.0 volts, to a data input of the first stage of shift register 302 in response to a DELAYED RESET control signal. Multiplexer 306 couples either a signal at $COL_0$ or power supply voltage $V_{DD}$ to a data input of the last stage of shift register 302 in response to a DELAYED RESET pulse. Right-shift operation is selected by LEFT/RIGHT direction signal applied to input 310. An initial system or power on RESET is applied to input terminal 312 to clear shift register 302, thereby deselecting all columns and blanking display 110. When video data is available, a DELAYED RESET is asserted to couple a logic 1 ($V_{DD}$) through multiplexer 304 to the first stage of shift register 302. Column clock $V_{COL}$ clocks the logic one into the first stage to produce a column drive signal at $COL_0$ to select a column of display 110. DELAYED RESET is then removed, which couples the signal at $COL_{119}$ through multiplexer 304 to the first stage of shift register 302. Column control circuit 112 thereby operates as a ring counter which circulates a column drive signal in a left to right direction, i.e., from $COL_0$ to $COL_{119}$ and back to $COL_0$.

Left-shift mode operates similarly, with LEFT/RIGHT direction signal configuring shift register 302 for left-shift operation similar to right-shift operation. After a system RESET clears shift register 302, a DELAYED RESET is asserted to couple a logic 1 state ($V_{DD}$) through multiplexer 306 to the last stage of shift register 302. A pulse from column clock $V_{COL}$ clocks the logic one to produce a column drive signal at $COL_{119}$ to select a column of display 110. DELAYED RESET is then removed, which couples the signal at $COL_0$ through multiplexer 306 to the last stage of shift register 302. Column control circuit 112 thereby operates as a ring counter which circulates a column drive signal in a right to left direction, i.e., from $COL_{119}$ to $COL_0$ and back to $COL_{119}$.

FIG. 4 shows a further detail of shift register 302 including the first two stages, stage 0 and stage 1. The remaining stages of shift register 302 provide the same function as stages 0 and 1. Shift register 302 is clocked by column clock $V_{COL}$ applied at clock inputs of flip-flops 410 and 414. Stage 0 and stage 1 have respective outputs $COL_0$ and $COL_1$ respectively coupled to columns of display 110. Stage 0 includes a multiplexer 408 and a flip-flop 410. Stage 1 comprises of a multiplexer 412 and a flip-flop 414.

Direction signal LEFT/RIGHT controls which input signals are produced at the outputs of multiplexers 408 and 412. In the right-shift mode, the signal from multiplexer 304 is coupled through multiplexer 408 to the data input of flip-flop 410 and the signal from $COL_0$ is coupled through multiplexer 412 to the data input of flip-flop 414. In the left-shift mode, the signal from $COL_1$ is shifted through multiplexer 408 to the data input of flip-flop 410 and the signal from $COL_2$ is coupled through multiplexer 412 to the data input of flip-flop 414. Data is shifted to successive stages on each pulse of column clock $V_{COL}$.

Referring to FIG. 5, row control circuit 108 is shown including a stack of 72 row drivers 502, a pulse width counter 504 and a data buffer 506. Row driver 502 operates in either a graphics mode or a bilevel mode, according to a MODE SELECT signal applied to each row driver 502. Data buffer 506 is configured as a serial load, parallel out 72-stage shift register having a data capacity of four bits per stage. Video data stream $V_{DATA}$ is clocked into a serial input of data buffer 506 by system clock $V_{CLOCK}$ to produce 72 four-bit luminance words at 72 parallel four-bit outputs. The 72 outputs are coupled for loading luminance words into row drivers 502 in response to a pulse of column clock $V_{COL}$.

Row drivers 502 operate as pulse generators which produce activating pulses at conductors $ROW_0$ through $ROW_{71}$. In graphics mode, the pulsewidths of the activating pulses are determined by the value of the four-bit luminance words. The activating pulses illuminate the LED pixels for variable portions of the frame refresh or column select period. The slow response of the human eye has the effect of integrating the light emitted by the LED pixels such that a variable brightness level or gray scale shading is perceived. In bilevel mode, activating pulses are either turned off or turned on for the entire column select period for displaying text or alphanumeric characters.

Pulse width counter 504 is a four-stage, free-running up counter incremented by a luminance clock $V_{LUM}$ derived from system clock $V_{CLOCK}$ Pulse width counter 504 produces a binary count at outputs $Q_0$–$Q_3$ which is coupled to the 72 row drivers 502. Luminance clock $V_{LUM}$ generates sixteen clock pulses which cycle pulse width counter 504 through sixteen binary count values during the period between successive pulses of column clock $V_{COL}$.

Referring to FIG. 6, further detail of row driver 502 is shown including a data buffer 602, a four-bit compare circuit 604, a flip-flop 606, a multiplexer 608, and a flip-flop 610. Row drivers 502 is shown as driving $ROW_0$ but row drivers 502 for driving other rows are configured substantially the same. A four-bit input receives the binary count from $Q_0$–$Q_3$ of pulse width counter 504 and a four-bit data input receives a luminance word from data buffer 506. An output at conductor $ROW_0$ provides an activating pulse whose width is indicative of the luminance word is produced at an output at conductor $ROW_O$.

Data buffer 602 is a four stage, parallel load, serial/parallel shift register having a four-bit data input which loads the four-bit luminance word on a pulse of column clock $V_{COL}$. Control signal MODE SELECT selects either graphics mode or bilevel mode operation and determines which of two data paths the luminance word takes before reaching the output at $ROW_0$.

In graphics mode, row driver 502 provides gray scale shading having four-bit resolution to illuminate a pixel as determined by the value of the luminance word. MODE SELECT configures data buffer 602 to operate as a parallel shift register. On a pulse of column clock $V_{COL}$, the luminance word is produced at four-conductor bus 612 for coupling to an input of compare circuit 604. When the value of the luminance word is 1–15, a $V_{COL}$ pulse also sets the output of flip-flop 606, which is coupled through multiplexer 608 to the data input of flip-flop 610. On the next pulse of system clock $V_{CLOCK}$, an activating pulse is commenced on conductor $ROW_0$ to illuminate a LED pixel. When the value of the luminance word is zero, the output of compare circuit 604 holds flip-flop 606 in a reset state so that an activating pulse is not commenced at $ROW_0$.

Compare circuit 604 comprises a four-bit comparator which compares the luminance word to the binary count from pulse width counter 504. When the binary count equals the luminance word, compare circuit 604 produces an output signal to resets flip-flop 606. The reset signal is coupled through multiplexer 608 to the data input of flip-flop 610 and clocked to $ROW_0$ on the next pulse of $V_{CLOCK}$ to terminate the activating signal and turn off the LED pixel.

The activating signal thereby provides four-bit gray scale shading by illuminating the selected LED pixel for a period represented by the value of the luminance word and the frequency of the luminance clock $V_{LUM}$. The human eye integrates the luminance of the LED pixel over a frame refresh period. A higher value of the luminance word causes the LED pixel to be illuminated for a longer portion of the frame refresh period, so that total luminance is increased and the LED pixel appears brighter. Table 1 shows the relationship of the value of the luminance word to the width of the activating pulse under the conditions that the period of $V_{COL}$ is approximately 139 microseconds during which $V_{LUM}$ produces sixteen pulses, i.e., a pulse every 8.7 microseconds.

TABLE 1

| Value of Luminance Word | Period of Activating Pulse (microseconds) |
|---|---|
| 0 | 0.0 |
| 1 | 8.7 |
| 2 | 17.4 |
| 3 | 26.1 |
| 4 | 34.8 |
| 5 | 43.5 |
| 6 | 52.2 |
| 7 | 60.9 |
| 8 | 69.6 |
| 9 | 78.3 |
| 10 | 87.0 |
| 11 | 95.7 |
| 12 | 104.4 |
| 13 | 113.1 |

TABLE 1-continued

| Value of Luminance Word | Period of Activating Pulse (microseconds) |
|---|---|
| 14 | 121.8 |
| 15 | 130.5 |

For bilevel mode operation, one luminance bit stored in data buffer 602 determines whether a pixel in display 110 is turned off or is turned on for a fixed period of time. A pulse of column clock $V_{COL}$ shifts the luminance bit serially to output 614. The luminance bit is coupled through multiplexer 608 to the data input of flip-flop 610. On the next pulse of system clock $V_{CLOCK}$ an activating pulse on $ROW_0$ begins which terminates on the next cycle when a pulse of $V_{COL}$ shifts a new luminance bit to output 614.

Most if not all logic families increase power consumption when the frequency of operation is increased. Recall that in graphics mode, a luminance word having four bits controls a display pixel, whereas in bilevel mode only one bit is needed. The dual mode operation of row control circuit 108 provides graphics capability, but at high frequency and power levels. When displaying text, both frequency and power are reduced. In particular, the transfer rate of luminance words, which is determined by the frequency of system clock $V_{CLOCK}$, is reduced to approximately 312.5 kilohertz because lower data rates are needed for displaying text. The frequency reduction can be accomplished while maintaining acceptable transfer and refresh rates of display 110.

Frequency reduction is implemented by frequency dividing system clock $V_{CLOCK}$ to a lower frequency using a frequency divider (not shown) whose divisor is controlled by control signal MODE SELECT. The circuits which are clocked by system clock $V_{CLOCK}$ operate at the highest speed in communications device 100 and therefore consume the most power. Substantial power saving is achieved by operating these circuits at a lower frequency. Power consumption is further reduced by disabling the circuits which are not used for bilevel mode operation, such as four-bit compare circuit 604 and flip-flop 606.

By now it should be appreciated that the present invention provides a flexible, low power, display driver for driving a display device. A column driver includes a shift register with display blanking and left/right bi-directional shifting capability. Parallel outputs scan the display in either direction so the column driver can be disposed in a portable communications device at either end of the display. A dual mode row driver provides graphics capability for displaying images and low power operation when displaying text. In graphics mode, a four-bit luminance data word controls a row drive pulse to produce a representative pixel brightness in a display. In bilevel mode, the system clock is reduced in frequency to conserve power while processing a reduced amount of data and maintaining refresh rates.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A display driver, comprising:

a switching circuit that selects a display mode in response to a mode select signal for providing display pixel control signals to a plurality of display inputs to control brightness levels where in a first display mode the switching circuit selects luminance signals representing levels of graphical shading and in a second display mode the switching circuit selects binary signals representing alphanumeric data; and a logic circuit having a plurality of storage locations where a select signal is shifted among the plurality of storage locations and selects a storage location coupled to an output for driving one of the plurality of display inputs.

2. The display driver of claim 1 wherein the switching circuit includes a plurality of multiplexers each including a first input coupled for receiving one of a plurality of luminance signals representing levels of graphical shading, a second input coupled for receiving one of a plurality of binary signals representing alphanumeric data, and an output for driving one of a plurality of display inputs.

3. The display driver of claim 2 further including:

a graphics mode circuit having an input coupled for receiving a multi-bit digital signal and having an output for providing the luminance signal having a duty cycle determined by the multi-bit digital signal; and a data buffer having an input coupled for receiving input data, a first output for providing the binary signal on a single conductor, and a second output for providing the multi-bit digital signal to the graphics mode circuit on multiple conductors.

4. The display driver of claim 3 wherein the graphics mode circuit includes:

a counter having an output for providing a count signal;

a comparator having a first input coupled to the output of the counter, and a second input coupled for receiving the multi-bit digital signal from the data buffer; and a latch having a set input coupled for receiving a clock signal, a reset input coupled to an output of the comparator, and an output for providing the luminance signal having a duty cycle determined by the multi-bit digital signal.

5. The display driver of claim 2 further including:

a plurality of column conductors;

a plurality of row conductors respectively coupled to the plurality of display inputs; and a plurality of pixel elements each having a first terminal coupled to one of the plurality of column conductors and a second terminal coupled to one of the plurality of row conductors.

* * * * *